US006367494B1

(12) United States Patent
Tung

(10) Patent No.: US 6,367,494 B1
(45) Date of Patent: Apr. 9, 2002

(54) MOVABLE SUNSHADE BASE

(76) Inventor: Benson Tung, No. 587, Chien-Gong Road, San-Min, Kaohsiung (TW)

( * ) Notice: Subject to any disclaimer, the term of this patent is extended or adjusted under 35 U.S.C. 154(b) by 0 days.

(21) Appl. No.: 09/765,944

(22) Filed: Jan. 19, 2001

(51) Int. Cl.[7] ..... E04H 15/26

(52) U.S. Cl. ..... 135/99; 135/48; 135/44; 135/84; 135/85; 248/129; 248/910; 248/346.01

(58) Field of Search ..... 135/99, 48, 44, 135/84, 85; 248/129, 910, 346.01; 40/606, 612; 280/47.27, 47.131

(56) References Cited

U.S. PATENT DOCUMENTS 5,220,740 A * 6/1993 Broult ..... 40/608
5,875,578 A * 3/1999 Grewe ..... 40/608
6,299,183 B1 * 1/2000 Kaneko ..... 280/47.26
6,053,825 A * 4/2000 Allen et al. ..... 473/479

* cited by examiner

*Primary Examiner*—Beth A. Stephan
*Assistant Examiner*—Chi Nguyen
(74) *Attorney, Agent, or Firm*—Alan Kamrath; Rider, Bennett, Egan & Arundel, LLP

(57) ABSTRACT

A sunshade base comprises a base adapted to engage with a support tube of a sunshade and two wheel assemblies each having a mounting plate and at least one wheel. The mounting plate is pivotally mounted to the base. The wheel is rotatably mounted to the mounting plate. The mounting plate is pivotable between a storage position in which the wheel does not contact the ground and an operative position in which the wheel is located on the ground and thus raises the base above the ground.

15 Claims, 8 Drawing Sheets

MOVABLE SUNSHADE BASE

BACKGROUND OF THE INVENTION

1. Field of the Invention

The present invention relates to a movable sunshade base.

2. Description of the Related Art

A typical sunshade may provide a shield for people. The sunshade is bulky and heavy and thus requires a base to provide a stable support. The base has a considerable weight of tens of kilograms. As a result, it is difficult and inconvenient to move the sunshade to a desired position. The present invention is intended to provide a movable sunshade base to provide the sunshade with maneuverability.

SUMMARY OF THE INVENTION

A sunshade base in accordance with the present invention comprises a base adapted to engage with a support tube of a sunshade and two wheel assemblies each having a mounting plate and at least one wheel. The mounting plate is pivotally mounted to the base. The wheel is rotatably mounted to the mounting plate. The mounting plate is pivotable between a storage position in which the wheel does not contact the ground and an operative position in which said at least one wheel is located on the ground and thus raises the base above the ground.

The base includes two opposite first sides and two opposite second sides, each first side having an opening. The mounting plate of each wheel assembly covers an associated opening and is flush with an associated first side when the mounting plate is in the storage position. Each mounting plate includes a horizontal slot for grasp.

Each wheel assembly includes two said wheels and each mounting plate includes two arms to which the wheels are rotatably mounted, respectively. The base includes a bottom with a peripheral edge and each arm includes a hook for engaging with the peripheral edge of the base when the wheel assembly is in the operative position. The arms include aligned holes through which an axle extends. The axle also extends through the wheels and includes a first enlarged end and a threaded second end for engaging with a nut to preventing disengagement of the wheels.

Each second side of the base includes a horizontal slot for grasp while moving the base. Two brackets are provided for each mounting plate and each include a horizontal section fixed to an inner face of a top of the base. Each bracket further includes an inclined section fixed to an inner face of an associated first side. A pivotal section is formed between the horizontal section and the inclined section and includes a pivotal hole for pivotal engagement with the mounting plate. Each mounting plate includes an inclined portion and a bearing portion on an upper end of the inclined portion. The bearing portion includes two pivotal pins on both sides thereof for pivotal engagement with the pivot holes of the brackets, respectively.

A rod secured to the base for engaging with the support tube of the sunshade. In an embodiment of the invention, the base includes a central vertical hole and a seat is secured on top of the base. The seat has an outer diameter greater than an inner diameter of the central vertical hole and includes a flange on a side thereof. The flange is fittingly mounted in the central vertical hole and has an extension extending downward therefrom. A transverse hole is defined in the extension, a receptacle being defined in the seat and extending into the flange and the extension. The rod includes a lower end received in the receptacle. A pin extends through a transverse hole in the lower end of the rod and the transverse hole of the extension, and the support tube of the sunshade is engaged with an upper end of the rod.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
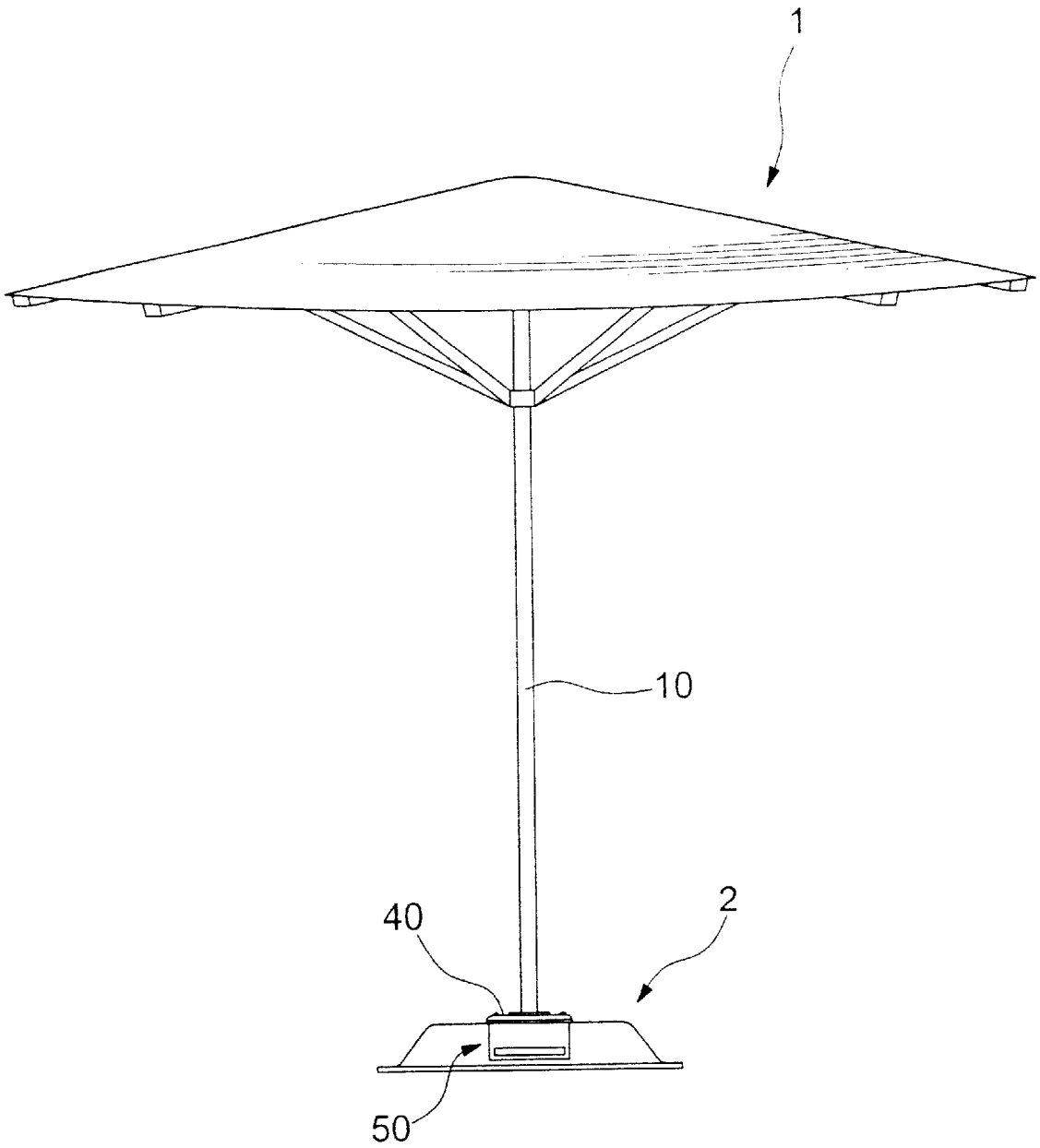
FIG. 1 is a side view of a sunshade supported by a sunshade base in accordance with the present invention.
Figure 2:
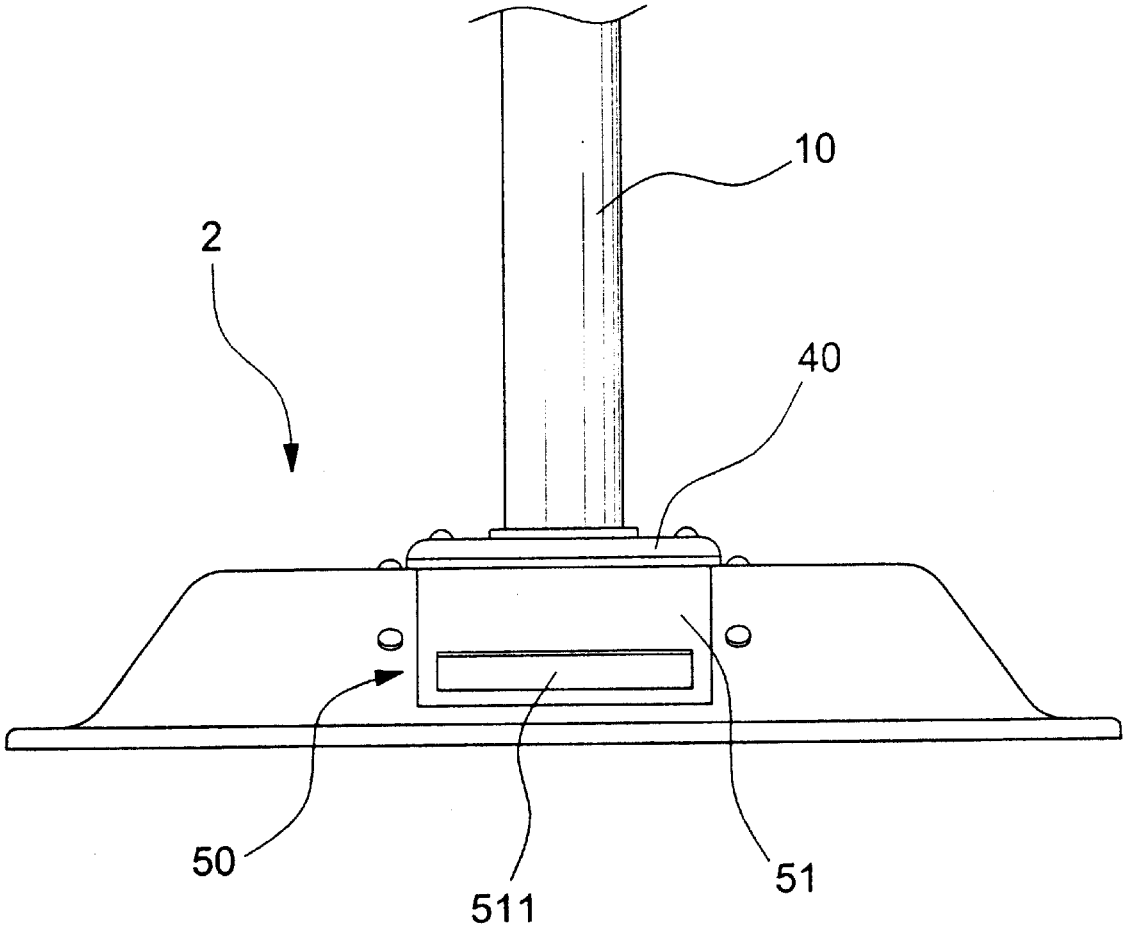
FIG. 2 is an enlarged side view of a lower portion of the sunshade and the sunshade base in accordance with the present invention.
Figure 3:
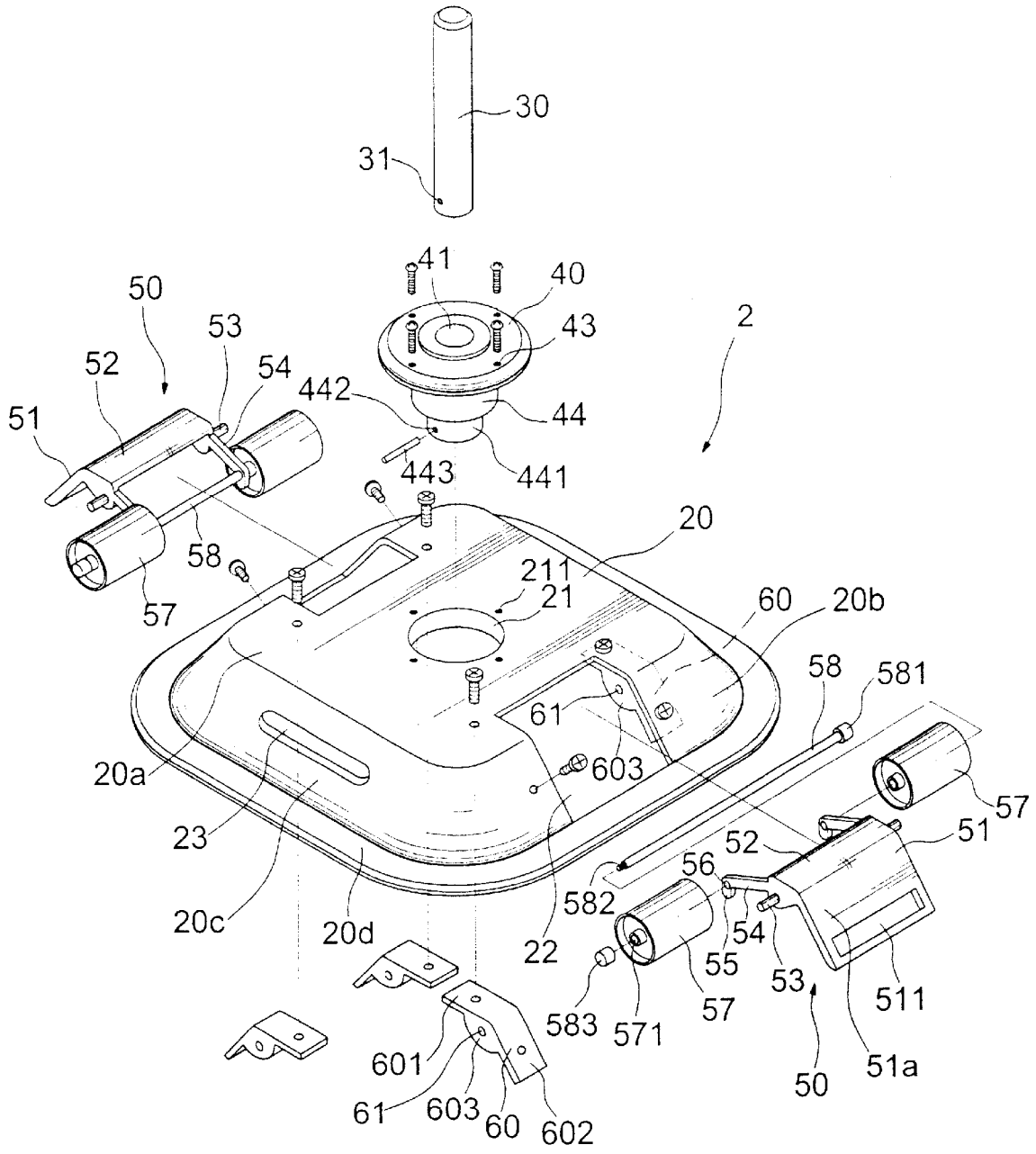
FIG. 3 is an exploded perspective view of the sunshade base in accordance with the present invention.
Figure 6:
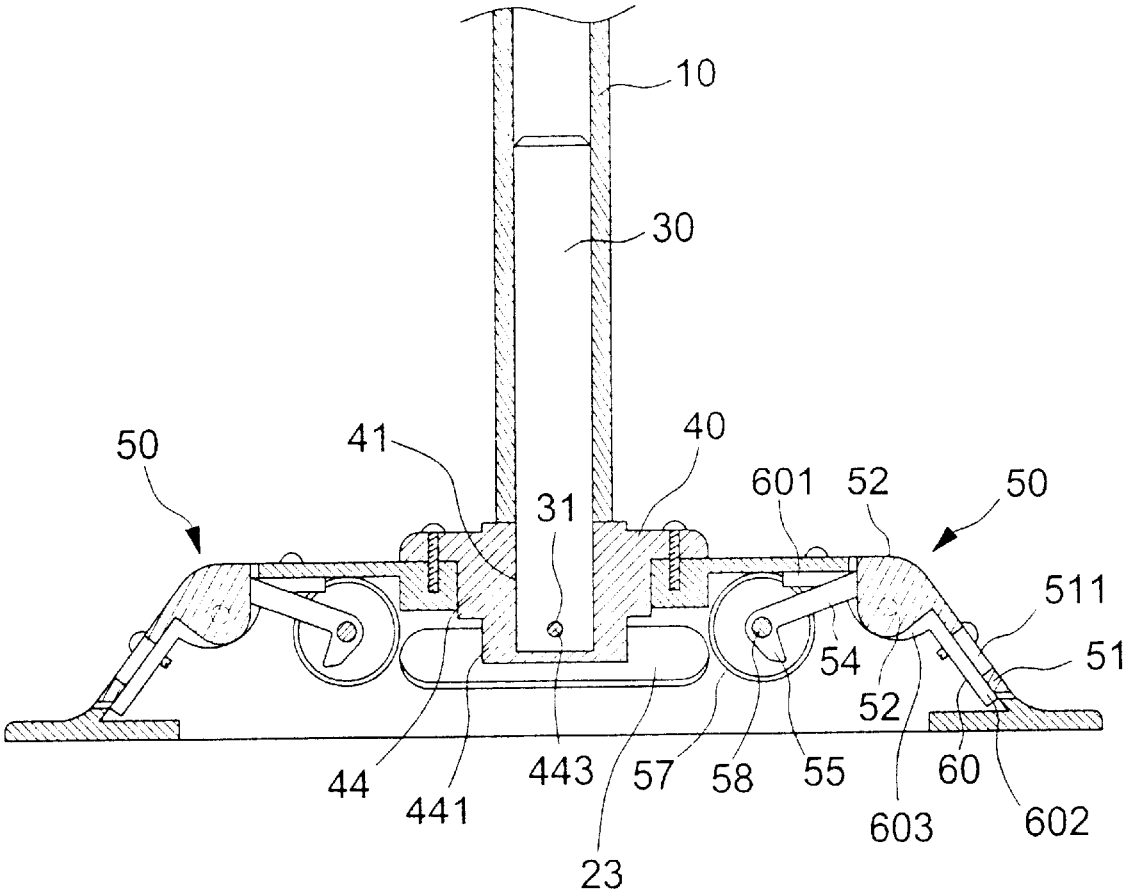
FIG. 6 is a sectional view of the sunshade and sunshade base in FIG. 2.

Referring to FIG. 1, a sunshade base 2 in accordance with the present invention is provided to support a support tube 10 of a sunshade 1. Referring to FIGS. 2 and 3, the sunshade base 2 comprises a base 20 having a top face 20*a* with a central vertical hole 21 around which a plurality of screw holes 211 are defined. A seat 40 has an outer diameter greater than an inner diameter of the central vertical hole 21 and includes a flange 44 on a side thereof, the flange 44 having an outer diameter the same as the inner diameter of the central vertical hole 21. An extension 441 extends outward from an outer end face of the flange 44 and includes a transverse hole 442. A receptacle 41 is defined in the seat 40 and extends into the flange 44 and the extension 441 and thus communicates with the transverse hole 442. In assembly, as illustrated in FIGS. 3 and 6, the flange 441 of the seat 40 is fitted into the central vertical hole 21 of the base 20 and a lower end of a rod 30 is mounted into the receptacle 41 of the seat 40. A pin 443 is extended through a transverse hole 31 in the lower end of the rod 30 and the transverse hole 442 of the extension 441, thereby securing the rod 30 in place. Next, screws (not labeled) are extended through holes 43 in the seat 40 and then engage with the screw holes 211 of the base 20, thereby securing the seat 40 to the base 20. As illustrated in FIG. 6, a lower end of the support tube 10 of the sunshade 1 is mounted to the rod 30 and thus supported by the base 20.

The base 20 further includes two inclined opposite sides 20*b* each having an opening 22, and Each of the other two inclined opposite sides 20*c* of the base 20 includes a horizontal slot 23. Each opening 22 includes an upper end extending into the top face 20*a* of the base 20.

The sunshade base 2 further comprises two wheel assemblies 50 each including a mounting plate 51, an axle 58, and at least one wheel 57 (two in this embodiment). In this embodiment, the mounting plate 51 includes an inclined portion 51*a* with a horizontal slot 511 and a bearing portion 52 on an upper end of the inclined portion 51*a*. Two pivotal pins 53 are formed on two sides of the bearing portion 52 and pivotally received in pivotal holes 61 of the base 20. Two parallel arms 54 project outward from the bearing portion 52 and extend away from the inclined portion 51 a of the mounting plate 51 and each have a distal end with a hole 56 and a hook 55. The axle 58 includes an enlarged end 581 and is extended through the holes 56 of the arms 54 and a longitudinal hole 571 of each wheel 583, and a nut 583 is engaged with a threaded second end 582 of the axle 58.

For each opening 22, two brackets 60 are mounted to an inner face (not labeled) of an associated the base 20 and located on both sides of the opening 22. Each bracket 60 includes a horizontal section 601 fixed to an inner surface of the top of the base 20 and an inclined section 602 fixed to the inner face of the associated side of the base 20. The pivotal hole 61 is defined in a section 603 between the horizontal portion 601 and the inclined portion 602. Each pivotal pin 53 of each mounting plate 51 is pivotally received in an associated pivotal hole 61 to thereby allowing pivotal movement of the mounting plate 51 and the wheels 57 relative to the base 20.

Figure 4:
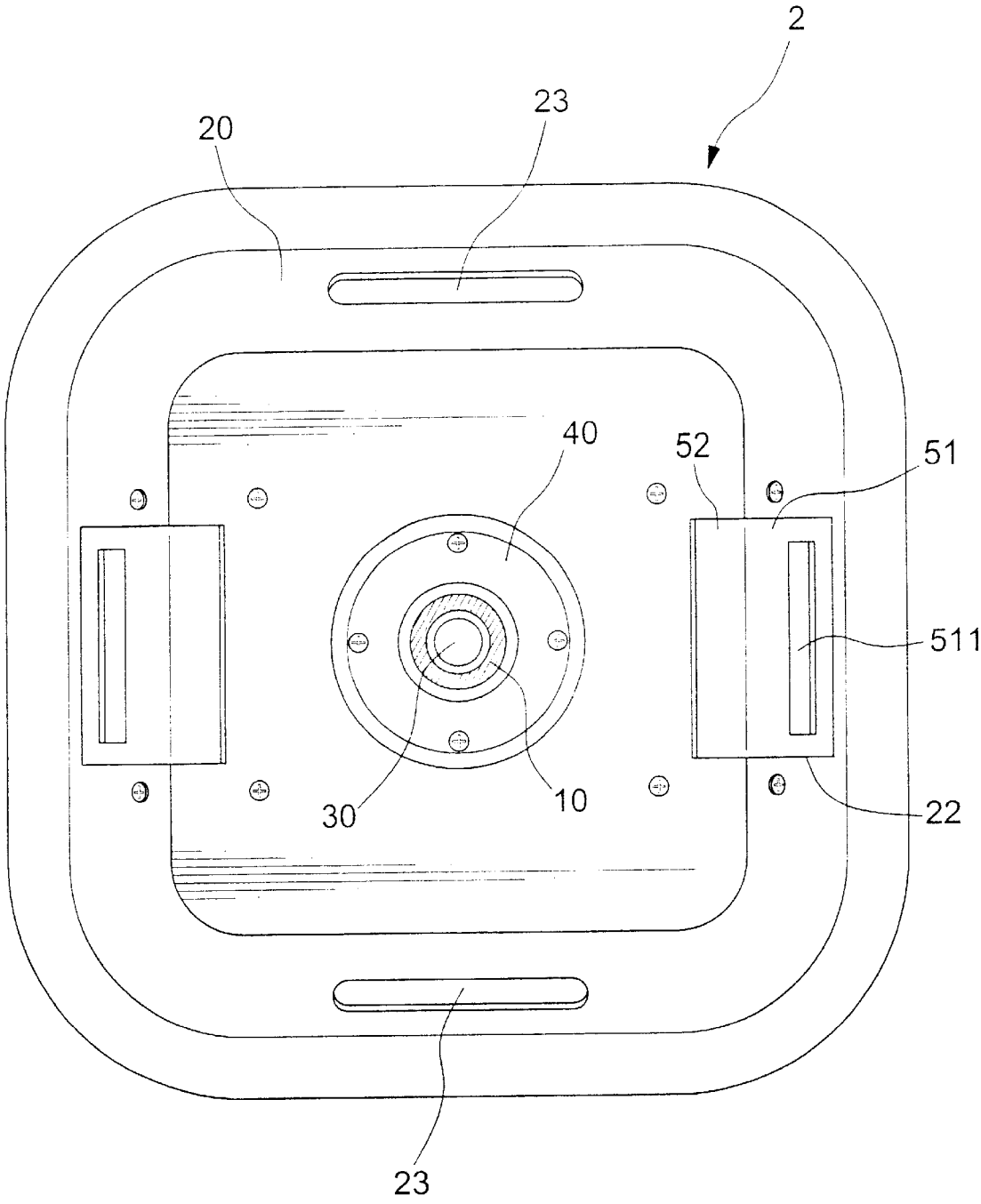
FIG. 4 is a top view of the sunshade base in accordance with the present invention.
Figure 5:
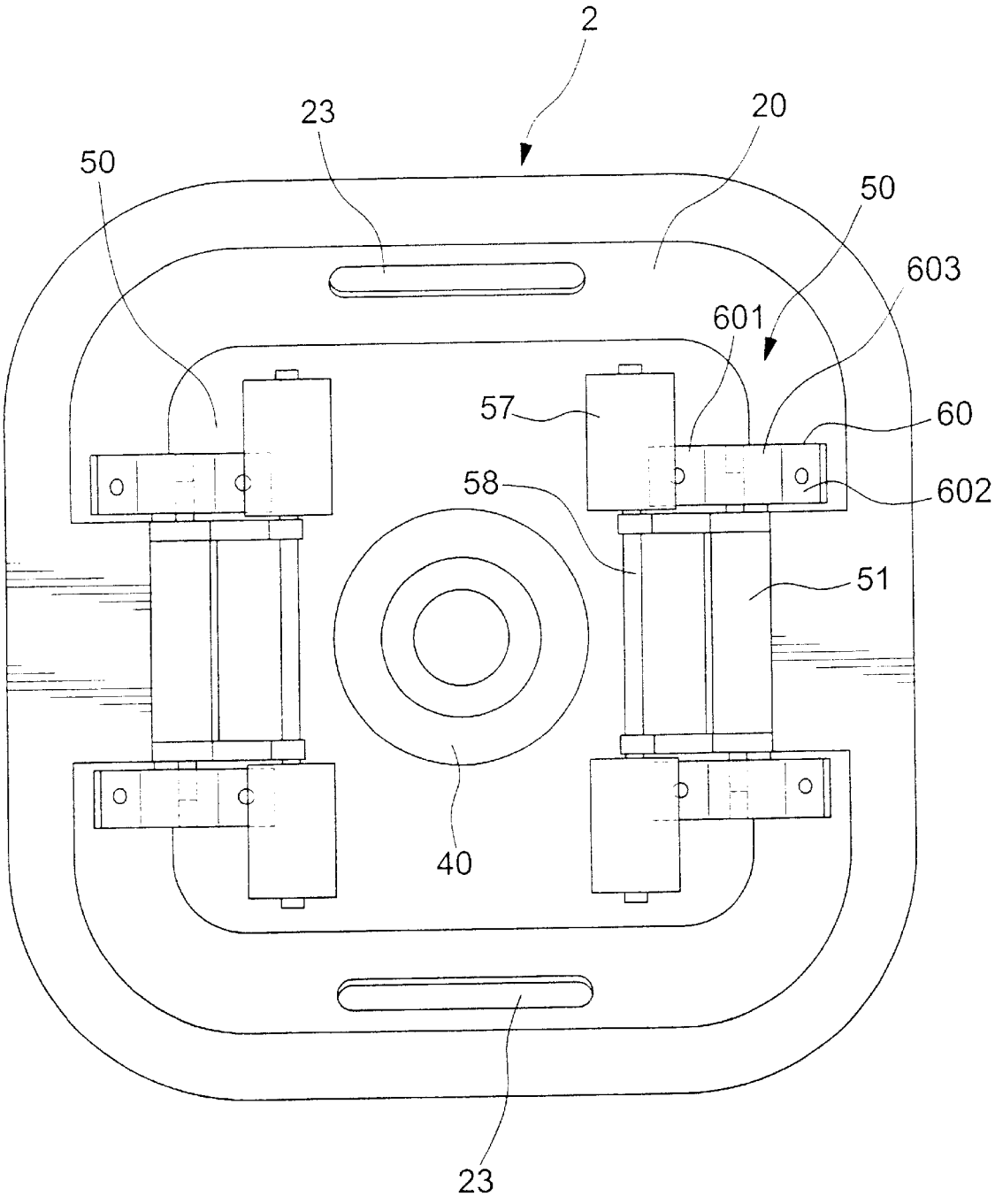
FIG. 5 is a bottom view of the sunshade base in accordance with the present invention.

FIG. 4 is a top view of the sunshade base 2 after assembly and FIG. 5 is a bottom view of the sunshade base 2 after assembly. FIG. 6 is a sectional view of the sunshade base 20, wherein the wheels 57 are in their storage position with each mounting plate 51 covering the opening 22 and thus being flush with an associated inclined side of the base 20.

Figure 7:
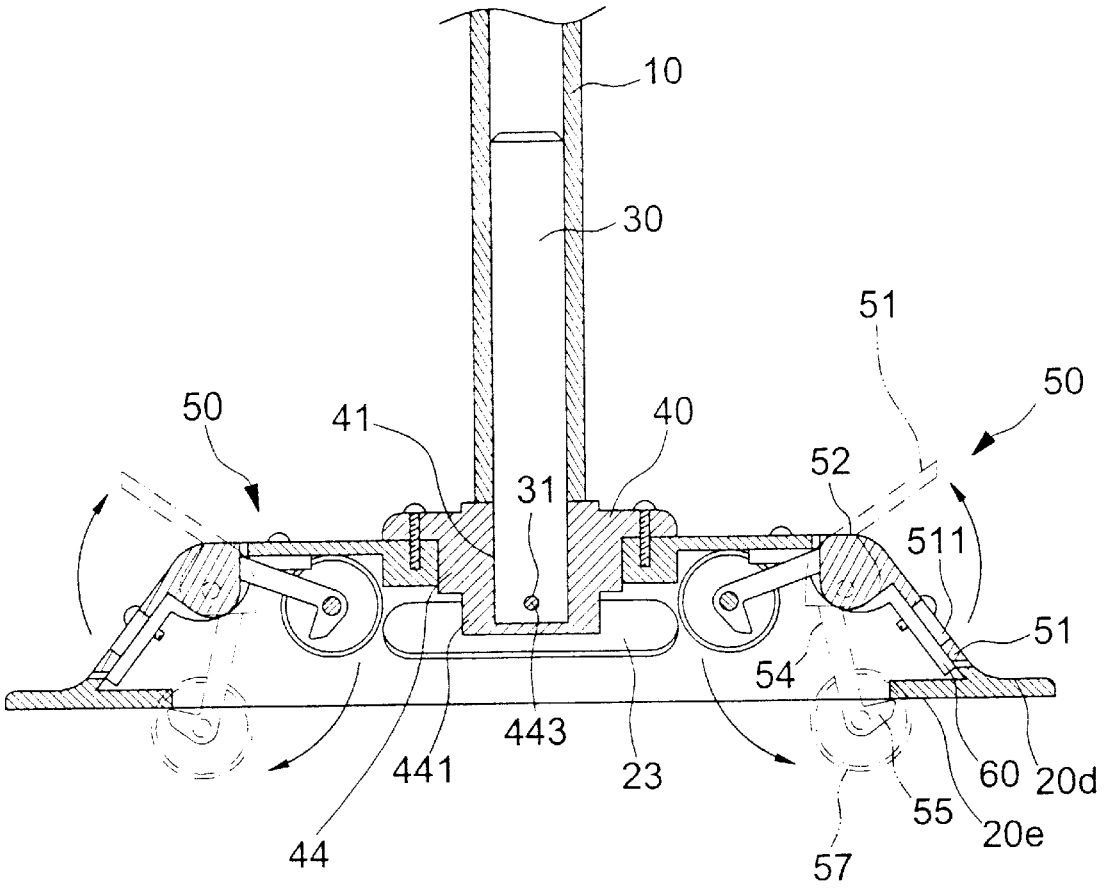
FIG. 7 is a sectional view similar to FIG. 6, illustrating adjustment of positions of two wheel assemblies of the sunshade base.
Figure 8:
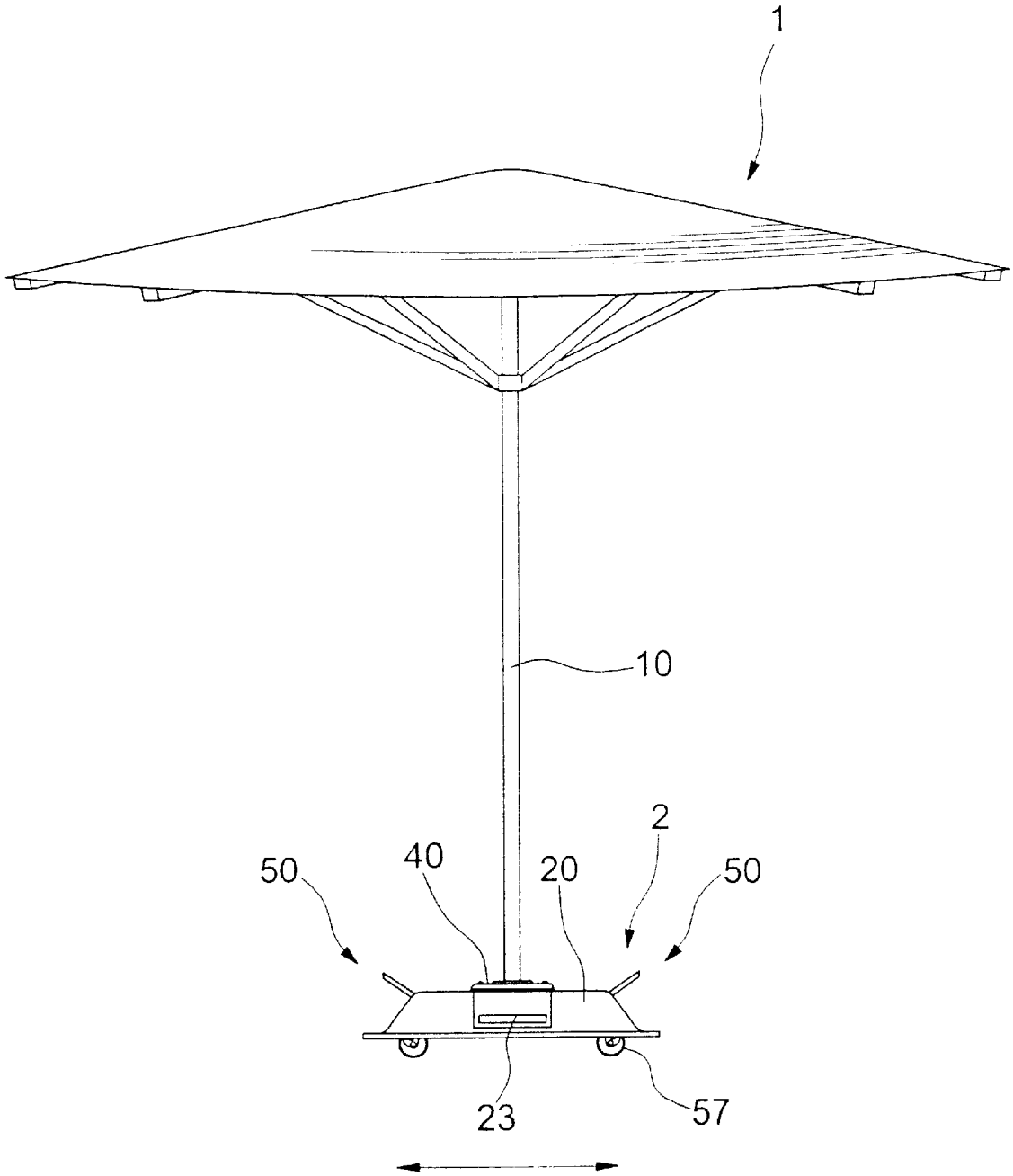
FIG. 8 is a side view illustrating movement of the sunshade base and the sunshade.

When the user intends to move the sunshade base 2, the user may insert his fingers into the slot 511 and grasp each mounting plate 51 and pivot the mounting plate 51 outward in a direction indicated by the arrow in FIG. 7 to a position shown by phantom lines in FIG. 7. The bearing portion 52 of the mounting plate 51 and an upper edge of an associated opening 22 have a gap therebetween to thereby allow pivotal movement of the mounting plate 51. The wheels 57 of each wheel assembly 50 are now moved to the ground and thus elevate raise the base 20 as well as the sunshade 1. The arms 56 for mounting the wheels 57 are oriented to prevent folding of the mounting plate 51. Namely, the arms 54 are exposed outside the base 20 when the associated mounting plate 51 is in the operative position and extend along a direction that is at an acute angle with respect to a vertical direction when the associated mounting plate 51 is in the operative position. It is noted that the hook 55 on each arm 56 of the mounting plate 51 is engaged with an inner edge 20*e* of a lower flange 20*d* of the base 2. Thus, the user may insert his fingers of each hand into an associated slot 23 and grasp the base 20 to thereby move the sunshade base 2 as well as the whole sunshade 10, best shown in FIG. 8. It is noted that the wheels 57 will not be retracted into their storage position during movement of the base 20, as the sunshade 1 and the sunshade base 2 have a considerable weight that will impose a downward force to the wheels 57 to prevent folding of the wheels 57.

Although not specifically shown in the drawings, it is appreciated that means may be provided to releasably retain the wheels 57 in their operative position. When the sunshade 1 reaches a desired position, the user may pivot the mounting plates 51 downward to move the wheels 57 into their storage position shown in FIG. 6. The wheels 57 may be replaced by casters to allow movement of the sunshade base 2 in any desired direction.

Although the invention has been explained in relation to its preferred embodiment, it is to be understood that many other possible modifications and variations can be made without departing from the spirit and scope of the invention as hereinafter claimed.

What is claimed is:

1. A sunshade base comprising:

a base adapted to engage with a support tube of a sunshade; and two wheel assemblies each having a mounting plate and at least one wheel, the mounting plate being pivotally mounted to the base, said at least one wheel being rotatably mounted to the mounting plate, the mounting plate being pivotable between a storage position in which the wheel does not contact the ground and an operative position in which said at least one wheel is located on the ground and thus raises the base above the ground.

2. The sunshade base as claimed in claim 1, wherein the base includes two opposite first sides and two opposite second sides, each said first side having an opening, the mounting plate of each said wheel assembly covering an associated said opening and being flush with an associated said first side when the mounting plate is in the storage position.

3. The sunshade base as claimed in claim 1, wherein each said mounting plate includes a slot for grasp.

4. The sunshade base as claimed in claim 3, wherein the slot is horizontal.

5. The sunshade base as claimed in claim 1, wherein each said wheel assembly includes two said wheels, each said mounting plate including two arms to which the wheels are rotatably mounted, respectively.

6. The sunshade base as claimed in claim 5, wherein the base includes a bottom with a peripheral edge, each said arm including a hook for engaging with the peripheral edge of the base when the wheel assembly is in the operative position.

7. The sunshade base as claimed in claim 5, wherein said arms include aligned holes through which an axle extends, the axle also extending through the wheels and including a first enlarged end and a threaded second end for engaging with a nut to preventing disengagement of the wheels.

8. The sunshade base as claimed in claim 2, wherein each said second side of the base includes a slot for grasp while moving the base.

9. The sunshade base as claimed in claim 2, further comprising two brackets for each said mounting plate, each said bracket including a horizontal section fixed to an inner face of a top of the base, each said bracket further including an inclined section fixed to an inner face of an associated said first side, a pivotal section being formed between the horizontal section and the inclined section and including a pivotal hole for pivotal engagement with the mounting plate.

10. The sunshade base as claimed in claim 9, wherein each said mounting plate includes an inclined portion and a bearing portion on an upper end of the inclined portion, the bearing portion including two pivotal pins on both sides thereof for pivotal engagement with the pivot holes of the brackets, respectively.

11. The sunshade base as claimed in claim 1, further comprising a rod secured to the base for engaging with the support tube of the sunshade.

12. The sunshade base as claimed in claim 11, wherein the base includes a central vertical hole, further comprising a seat secured on top of the base, the seat having an outer diameter greater than an inner diameter of the central vertical hole, the seat including a flange on a side thereof, the flange being fittingly mounted in the central vertical hole and having an extension extending downward therefrom, a transverse hole being defined in the extension, a receptacle being defined in the seat and extending into the flange and the extension, the rod including a lower end received in the receptacle and including a transverse hole aligned with the transverse hole of the extension, further including a pin extending through the transverse hole of the rod and the transverse hole of the extension, the support tube of the sunshade being engaged with an upper end of the rod.

13. The sunshade base as claimed in claim 1, wherein said at least one wheel of each said wheel assembly is completely hidden in the base.

14. The sunshade base as claimed in claim 13, wherein each said mounting plate including at least one arm to which said at least one wheel is rotatably mounted, said at least one arm of each said wheel assembly being exposed outside the base when the associated mounting plate is in the operative position.

15. The sunshade base as claimed in claim 14, wherein said at least one arm extend along a direction that is at an acute angle with respect to a vertical direction when the associated mounting plate is in the operative position.

* * * * *